US007775918B2

(12) United States Patent
Tsang

(10) Patent No.: US 7,775,918 B2
(45) Date of Patent: Aug. 17, 2010

(54) SOFT PROJECTILE

(75) Inventor: Kwok-Wah Tsang, Kowloon (CN)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 172 days.

(21) Appl. No.: 11/983,384

(22) Filed: Nov. 7, 2007

(65) Prior Publication Data

US 2009/0050010 A1 Feb. 26, 2009

(30) Foreign Application Priority Data

Aug. 21, 2007 (HK) ..... 07109100

(51) Int. Cl.
*A63B 65/02* (2006.01)

(52) U.S. Cl. ..... 473/572; 473/573

(58) Field of Classification Search ..... 473/572–576, 473/582; 273/DIG. 25
See application file for complete search history.

(56) References Cited

U.S. PATENT DOCUMENTS 1,774,765 A * 9/1930 Schoen ..... 473/572
1,918,718 A * 7/1933 Samsel ..... 473/572
2,119,524 A * 6/1938 Yew Char ..... 473/572
2,807,469 A * 9/1957 Swartz ..... 473/572
3,108,395 A * 10/1963 Goldfarb ..... 473/572
3,801,102 A * 4/1974 Lohr ..... 473/572
4,030,761 A * 6/1977 Daller ..... 473/572
4,944,520 A * 7/1990 Fingerson et al. ..... 473/582
5,066,017 A * 11/1991 Kurland ..... 473/572
5,928,049 A * 7/1999 Hudson ..... 473/577
7,364,521 B2 * 4/2008 Yang ..... 473/578
2006/0135298 A1 6/2006 Yang

FOREIGN PATENT DOCUMENTS

CN 2718505 Y * 6/2005
CN 2718505 Y 8/2005
DE 7526799 U 8/1975
DE 29805863 U 6/1998

OTHER PUBLICATIONS

Great Britain Search Report, dated Nov. 4, 2008, Application No. GB0716296.9.
Chinese Search Report, dated Sep. 26, 2007, Application No. HK07389.

* cited by examiner

*Primary Examiner*—Steven Wong
(74) *Attorney, Agent, or Firm*—Volpe and Koenig, P.C.

(57) ABSTRACT

A projectile for a toy shooting device includes a tubular body, a head molded of soft material, an anchor partially embedded in the head and comprising a fixing stem extending into and adhered to the tubular body.

7 Claims, 3 Drawing Sheets

SOFT PROJECTILE

BACKGROUND OF THE INVENTION

The present invention relates to soft projectiles or "darts" of the kind that might be deployed by toy shooting devices such as a toy guns. The invention more particularly although not exclusively, relates to a soft projectile having a suction cup at its leading end.

Such projectiles are often fired at smooth surfaces such as a wall or window pane. The suction cup at the leading end attaches the projectile to the smooth surface until such time as a child removes it.

An example of a known toy gun and soft projectile is shown in FIGS. 1 to 4. The toy gun 1 fires the soft projectile 2 as shown in FIG. 1. The soft projectile itself (FIGS. 2 to 4) comprises a hollow tubular body 3 made of lightweight semi-rigid foam or plastics material. A soft suction cup 4 made of rubber or other resilient (plastics) material has a flange 7 and a soft fixing stem 5. Adhesive 6 underneath the flange 7 and about the fixing stem 5 secures the suction cup 4 to the tubular body 3.

A problem discovered with this design is demonstrated in FIGS. 2 to 4. Moreover, when tension is placed on the projectile (as would typically occur when a child grasps the tubular body to detach the projectile from a window pane for example), the flange is pulled away from the leading end of the tubular body 3 as the soft fixing stem 5 extends longitudinally. As a result of a longitudinal extension of the fixing stem, it contracts inwardly and away from the inner surface of the tubular body in a radial direction thereby peeling away the adhesive 6 toward the inner end of the fixing stem until such time as the two parts become detached. The detached suction cup 4—being quite small in size—presents a choking danger to small children.

OBJECTS OF THE INVENTION

It is an object of the present invention to overcome or substantially ameliorate the above disadvantages and/or more generally to provide an improved soft projectile.

DISCLOSURE OF THE INVENTION

There is disclosed herein a projectile for a toy shooting device, comprising:

a tubular body;

a head moulded of soft material;

an anchor partially embedded in the head and comprising a fixing stem extending into the tubular body and adhered thereto.

Preferably, the anchor comprises a retaining disc embedded in the head and extending radially from the fixing stem.

Preferably, the retaining disc comprises one or more apertures extending therethrough.

Preferably, the soft material of the head extends through the aperture(s).

Preferably, the head comprises a suction cup.

Preferably, the head further comprises a flange within which the retaining disc is situated.

Preferably, the flange is affixed to the tubular body by adhesive.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
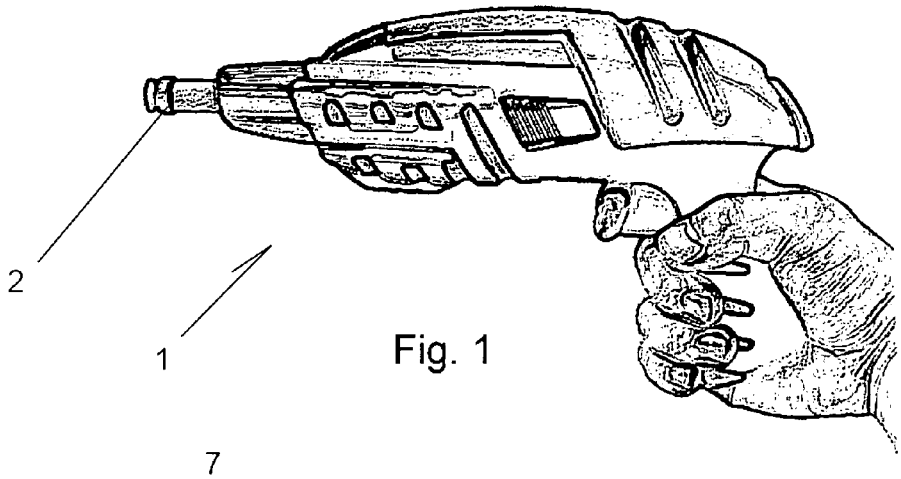
FIG. 1 is a schematic elevation of a typical toy gun and soft projectile.

FIG. 1 shows a typical toy shooting device in the form of a pistol 1 from which a soft projectile 2 is being fired.

Figure 2:
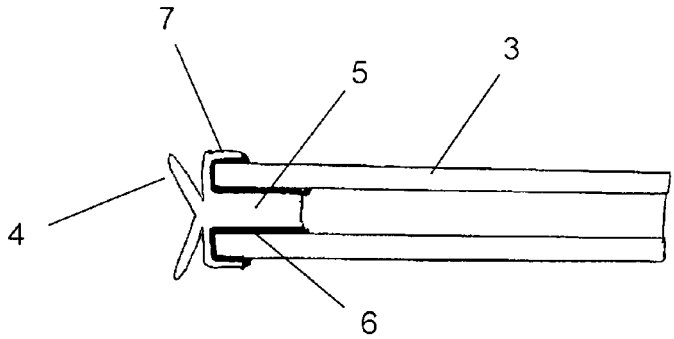
Fig. 2 (PRIOR ART)
FIG. 2 is a schematic cross-sectional elevation of a prior art soft projectile.
Figure 3:
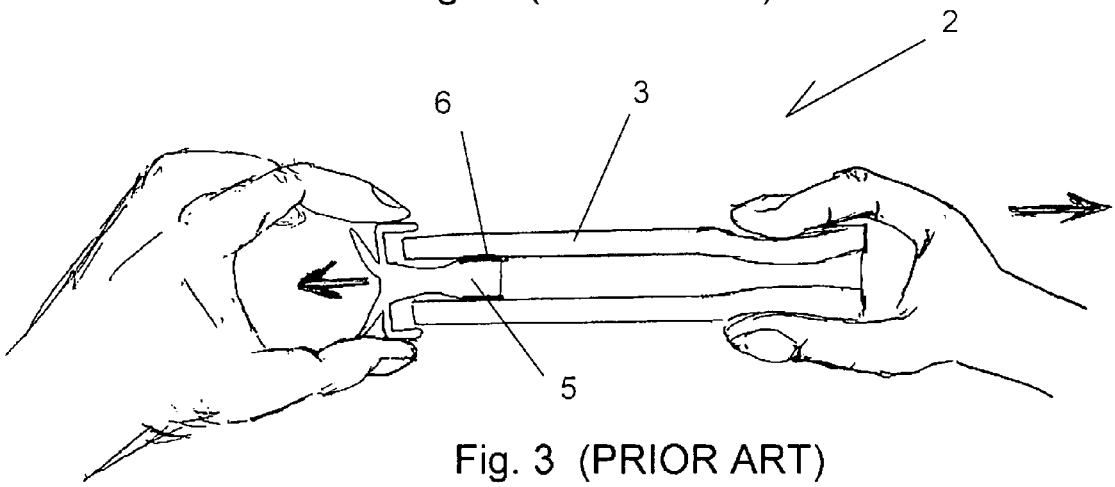
Fig. 3 (PRIOR ART)
FIG. 3 is a schematic cross-sectional elevation of the soft projectile of FIG. 2 under slight tension.
Figure 4:
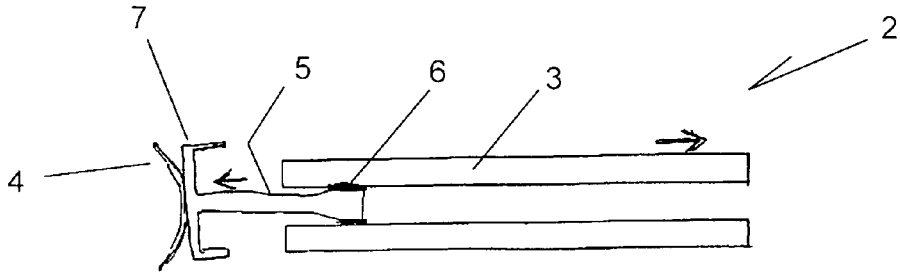
Fig. 4 (PRIOR ART)
FIG. 4 is a schematic cross-sectional elevation of the soft projectile of FIG. 3 under more tension.
Figure 5:
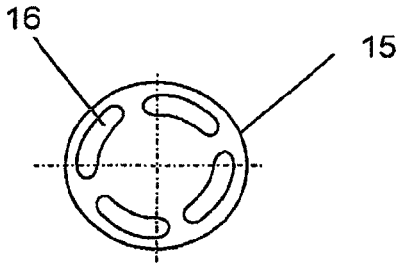
FIG. 5 is a schematic leading end elevation of an embedded anchor forming part of a new soft projectile.
Figure 6:
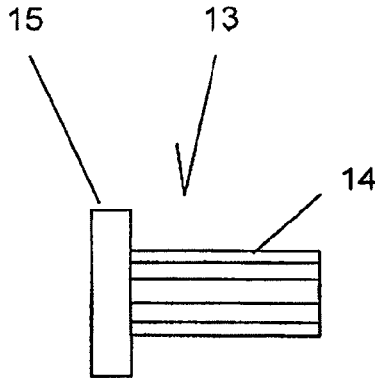
FIG. 6 is a schematic side elevation of the embedded anchor of FIG. 5.

A known soft projectile is depicted in FIGS. 2 to 4 and comprises a lightweight tubular body 3 having a head with a suction cup 4, a flange 7 and fixing stem 5. The flange and fixing stem are secured by adhesive 6 to the leading end of the tubular body 3. A problem associated with this design is described above.

Figure 7:
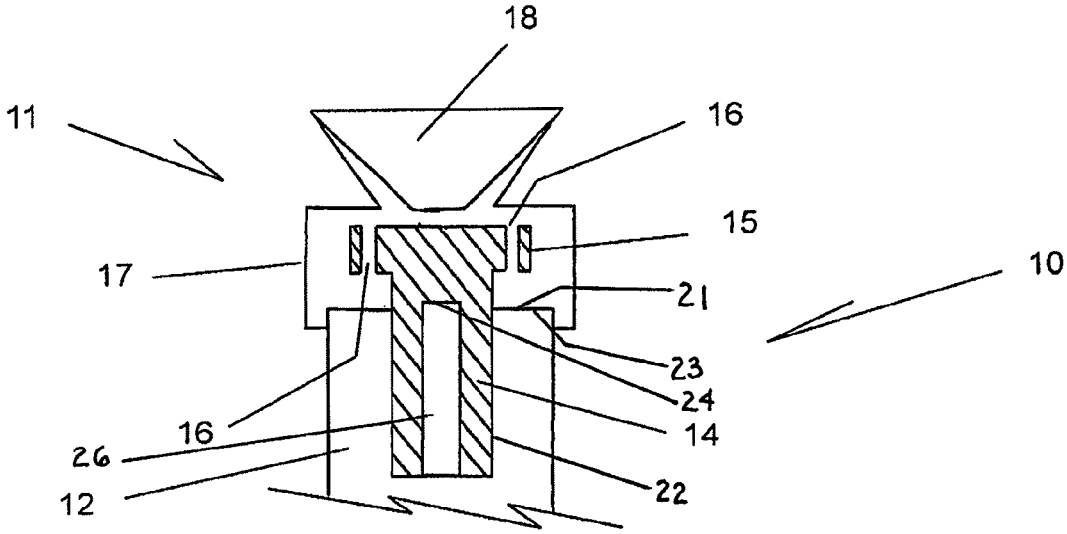
FIG. 7 is a schematic cross-sectional elevation of the leading portion of a new soft projectile.
Figure 8:
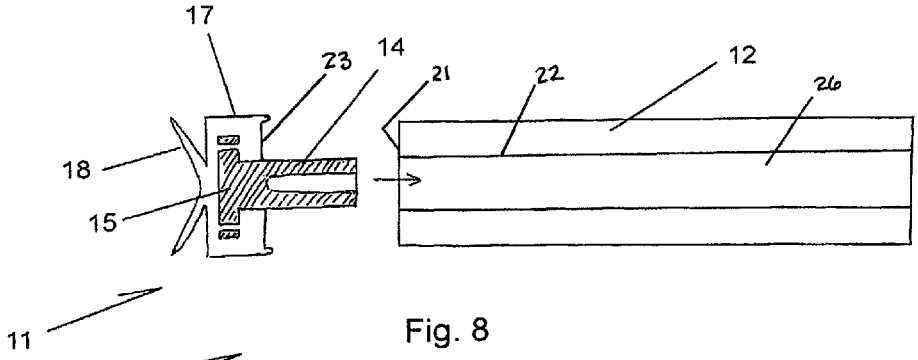
FIG. 8 is a schematic parts-exploded cross-sectional elevation of the new soft projectile.
Figure 9:
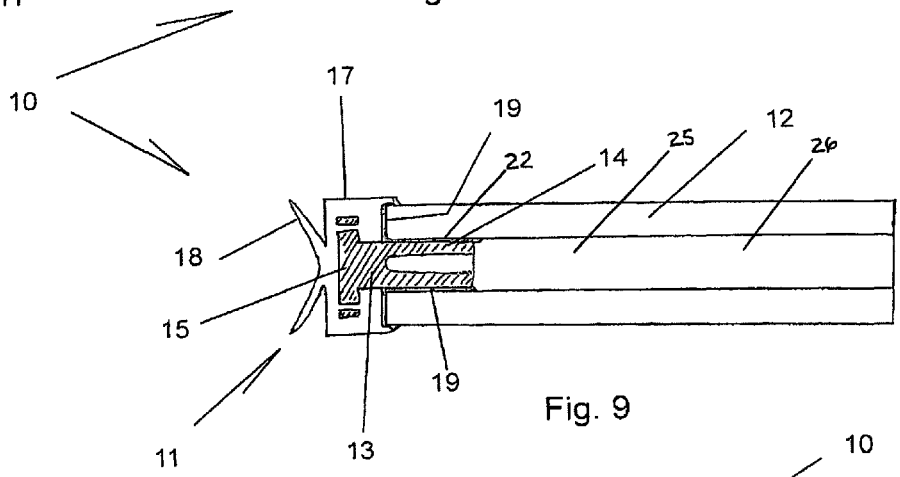
FIG. 9 is a schematic cross-sectional elevation of the new soft projectile.

FIGS. 5 to 10 depict the new design. The new projectile 10 comprises a soft head 11 typically made a rubber or moulded soft resilient plastics material and a tubular body 12 to which the soft head 11 is secured by means of an embedded fixing anchor 13. The tubular body 12 is typically made of a semi-rigid lightweight foam or plastics material, and includes an end face 21 and an opening 22 that extends through the body 12, as shown in FIGS. 7-9. A facing portion 23 of the head 11 is adhered to the end face 21 with adhesive 19, as shown.

Figure 10:
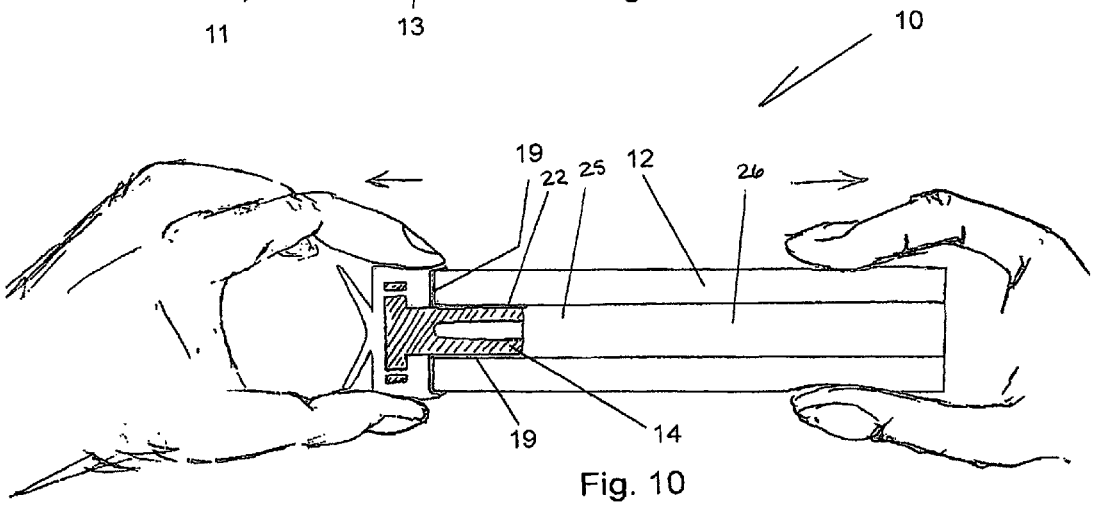
FIG. 10 is a schematic cross-sectional elevation of the new soft projectile under tension.

The fixing anchor 13 is typically formed of moulded rigid plastics material. The fixing anchor 13 comprises a fixing stem 14 and an integral disc 15 extending radially from one end of the stem. As shown in FIGS. 7-9, the fixing stem 14 extends out from the head 11, is received by the opening 22 and adhered to an inside thereof. As shown in FIG. 7, the fixing stem 14 has a hollow interior 26 that is closed off at an end 24 facing the retaining disc 15. The hollow interior 26 joins the opening 22 of the tubular body 12 to form a continuous cavity 25, as shown in FIGS. 9 and 10. The disc 15 comprises a number of apertures 16 extending therethrough. The apertures 16 extend through the disc in the longitudinal direction of the projectile 10.

The soft head 11 comprises a suction cup 18 and a flange 17 located behind the suction cup. The head 11 is moulded onto the anchor 13 such that the disc 15 is contained within the flange 17. During the moulding operation, the material of the head 11 flows into and through each of the apertures 16 so as to permanently embed the disc in the head with the fixing stem 14 extending from behind the flange 17.

The head 11 with embedded anchor 13 is attached to the tubular body 13 with adhesive 19. Adhesive 19 is situated about the projecting portion of the fixing stem 14 and behind the flange 17 so as to secure the head 11 to the tubular body 12 at both its forward end and forward internal portion.

As the anchor 13 is of substantially rigid material (as compared to the materials from which the head 11 and tubular body 12 are made), it will not elongate and radially contract when tension is applied as demonstrated in FIG. 10. The so-constructed projectile will be far less likely to break apart when tension is applied -thereby being safer for children.

It should be appreciated that modifications and alterations obvious to those skilled in the art are not to be considered as beyond the scope of the present invention. For example, rather than providing a suction cup, the soft head might be provided with a simple dome for bouncing off a hard surface in use.

The invention claimed is:

1. A projectile for a toy shooting device, comprising:

a head moulded of soft material;

an anchor made of a rigid material having a retaining disc embedded permanently in the head and a fixing stem extending out from the head; and a tubular body having an end face with an opening generally complementary to the stem, which receives the stem, the stem and a facing portion of the head being adhered to an inside of the opening and the end face, respectively;

wherein the retaining disc comprises at least one aperture extending therethrough.

2. The projectile of claim 1, wherein the soft material of the head extends through the at least one aperture.

3. The projectile of claim 2, wherein the head comprises a suction cup.

4. The projectile of claim 3, wherein the head further comprises a flange within which the retaining disc is situated.

5. The projectile of claim 4, wherein the flange is affixed to the tubular body by adhesive.

6. The projectile of claim 1, wherein the stem is hollow and is closed off at an end facing the retaining disc.

7. The projectile of claim 6, wherein the opening extends through the tubular body and forms a continuous cavity with the hollow stem.

* * * * *